United States Patent [19]

Resh

[11] Patent Number: 4,764,648

[45] Date of Patent: Aug. 16, 1988

[54] SWITCH ASSEMBLY WITH ACTUATOR FOR SEQUENTIALLY ACTIVATING TWO SAFETY SWITCHES

[75] Inventor: John Resh, Valparaiso, Ind.

[73] Assignee: McGill Manufacturing Co., Inc., Valparaiso, Ind.

[21] Appl. No.: 90,662

[22] Filed: Aug. 28, 1987

[51] Int. Cl.[4] ..... H01H 9/20

[52] U.S. Cl. ..... 200/50 A; 200/50 C; 200/61.62

[58] Field of Search ..... 200/1 B, 17 R, 18, 50 A, 200/50 C, 61.62, 61.64, 330–332; 219/10.55 B, 10.55 C, 10.55 D

[56] References Cited

U.S. PATENT DOCUMENTS

| | | | |
|---|---|---|---|
| 4,516,007 | 5/1985 | Ringdahl et al. | 200/59 A X |
| 4,529,852 | 7/1985 | Lewandowski | 200/50 A |
| 4,663,505 | 5/1987 | Drake | 200/50 A X |

*Primary Examiner*—J. R. Scott

*Attorney, Agent, or Firm*—Leydig. Voit & Mayer

[57] ABSTRACT

A safety switch assembly for an electrical appliance to prevent the appliance from being operated unless its door is fully closed and latched. The switch assembly includes a first switch activated by a pivoted lever and a second switch activated by a slidable block carried by the lever. The lever and the block are sequentially moved to switch-activating positions as the latch of the appliance moves to a fully latched position.

7 Claims, 2 Drawing Sheets

SWITCH ASSEMBLY WITH ACTUATOR FOR SEQUENTIALLY ACTIVATING TWO SAFETY SWITCHES

BACKGROUND OF THE INVENTION

This invention relates generally to a switch assembly and, more particularly, to a switch assembly which is used in conjunction with the door latch of an electric appliance such as a microwave oven.

The doors of certain types of microwave ovens include a pivoted latch which is biased to swing downwardly to a latched position. As the door approaches its closed position, the latch rides upwardly along a ramped strike located in the cabinet of the appliance. When the door reaches its fully closed position, the latch springs downwardly into latching engagement with the strike and acts to releasably hold the door closed.

The oven includes circuitry which is responsive to the position of the latch and which prevents operation of the oven if the door is not fully closed and latched. In one particular oven, the circuitry includes two snap-action switches which are sequentially activated by the latch as the door is closed and as the latch moves to its latched position. The oven cannot be operated unless both switches have been activated by the latch.

In prior arrangements of this type, the switches are operated by actuators in the form of sheet metal levers which are attached to the switches and which are engaged by the latch as the door is closed. Such levers are rather intricate in shape and are relatively expensive to make and assemble.

SUMMARY OF THE INVENTION

The general aim of the present invention is to provide a new and improved switch assembly having a comparatively simple and low cost actuator for operating a pair of switches in response to movement of a probe such as a latch.

A more detailed object of the invention is to provide a switch actuator comprising a pivoted lever which is adapted to operate one of the switches upon being intially engaged by the latch and which carries a slidable actuating element for operating the other switch as the latch snaps into its fully latched position.

The invention also resides in the relatively simple molded construction of the actuating lever and of the actuating element which is carried by the lever.

These and other objects and advantages of the invention will become more apparent from the following detailed description when taken in conjunction with the accompanying drawings.

DETAILED DESCRIPTION OF THE PREFERRED EMBODIMENTS

Figure 1:
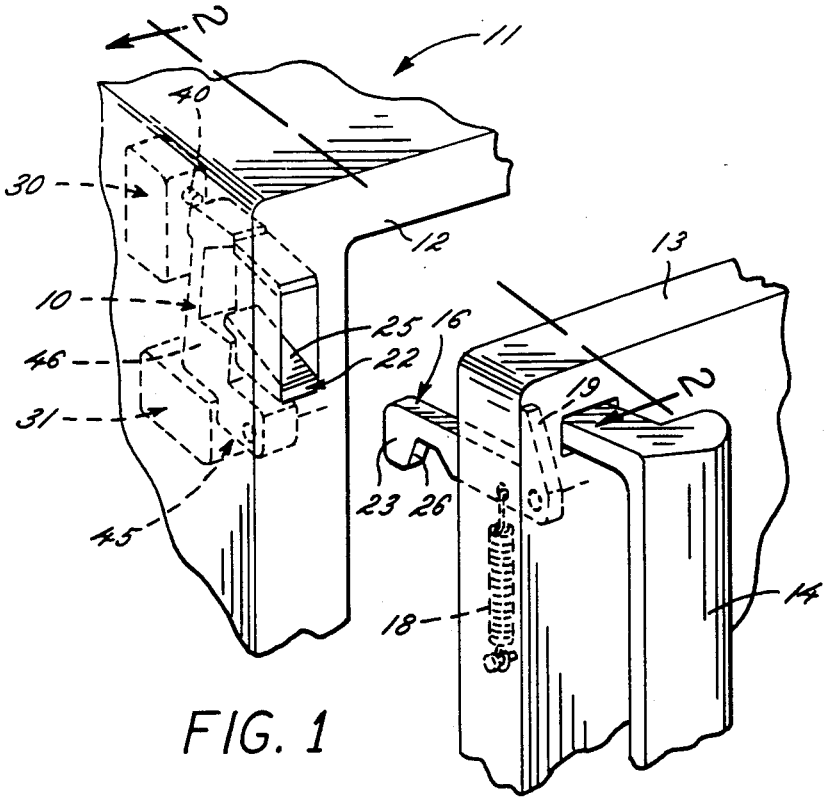
FIG. 1 is a fragmentary perspective view of a typical appliance equipped with a new and improved switch assembly incorporating the unique features of the present invention, the door of the appliance being shown in an open position.

For purposes of illustration, the present invention has been shown in the drawings as embodied in a switch assembly 10 which is used in conjunction with an electrical appliance such as a microwave oven 11. The oven 11 itself is of conventional construction and includes the usual cabinet 12 adapted to be closed by a hinged door 13 which is pivotally mounted on the cabinet to swing about a vertical axis. The door includes a bail-like handle 14 located adjacent the free edge portion of the door and adapted to be rocked about a vertical pivot 15 (FIG. 2) before being pulled to open the door.

Supported by the door 13 is a latch 16 for releasably holding the door in a closed position. The latch is pivotally mounted at 17 (FIG. 2) to swing upwardly and downwardly about a horizontal axis and is urged clockwise or downwardly to a latched position by a contractile spring 18. An ear 19 projects upwardly from one end portion of the latch and extends into an opening 20 in the handle 14. When the handle is rocked about the pivot 15, an edge of the opening 20 engages the ear 19 and causes the latch to swing counterclockwise about the pivot 17 to an unlatched position. It should be understood that other arrangements such as a push button could be used to actuate the latch.

The switch assembly 10 is located in the cabinet 12 in opposing relation with the latch 16 and includes a switch mounting member which herein is in the form of a flat plastic plate 21 (FIG. 2) disposed in a vertical plane and fastened securely to the cabinet. Formed integrally with the plate 21 is a strike 22 which coacts with a depending nose 23 on the latch in order to hold the door 13 releasably in its closed position.

In this instance, the strike 22 is formed with a ramp 25 which slopes upwardly as it progresses rearwardly into the cabinet 12. As the door closes, the nose 23 of the latch 16 engages the ramp 25 and rides upwardly along the ramp so as to cam the latch counterclockwise against the action of the spring 18 (see FIG. 2). With further closing of the door, the nose 23 of the latch drops downwardly off of the rear end of the ramp 25 to allow the spring to pivot the latch clockwise toward its latched position. When the nose 23 first drops off of the ramp 25, however, an inclined surface 26 on the nose engages the rear edge of the ramp and temporarily prevents the latch from pivoting to its fully latched position (see FIG. 4). With further movement of the door to its fully closed position (FIG. 5), the inclined surface 26 of the nose 23 clears the rear edge of the ramp 25 sufficiently to allow the latch 16 to pivot to its fully latched position as shown in FIG. 5. In this position, the nose 23 of the latch engages the rear edge of the ramp 25 of the strike to hold the door 13 releasably in its closed position. When the handle 14 is rocked about the pivot 15 and then is pulled outwardly, the nose of the latch releases the strike so as to permit opening of the door.

The latch 16 serves as a probe to effect operation of a pair of safety switches 30 and 31 when the door 13 reaches its fully closed position. The switches are connected in the energizing circuit of the microwave oven 11 and prevent the oven from being operated unless the door is fully closed and the switches are both triggered.

Each of the present switches 30 and 31 includes a plastic housing 33 formed with holes for receiving mounting pins 34 formed integrally with and projecting from the plate 21. In addition, each switch is captivated on the plate by two cantilevered fingers 35 which also are formed integrally with the plate.

The switch 30 is a conventional single pole, normally closed snap switch and includes a spring-loaded operator or plunger 40 which extends forwardly. The switch 31 is a conventional single pole, double throw snap switch and it includes a spring-loaded operator or plunger 41 which extends upwardly. The switches are activated when the plungers are depressed into the housings 33 to triggered positions and are de-activated when the internal springs return the plungers outwardly.

In accordance with the present invention, the switch assembly 10 includes a very simple and comparatively inexpensive actuator 45 for activating the switches 30 and 31 in response to movement of the latch 16 to its latched position. The actuator 45 is characterized in that it may be easily molded from plastic and eliminates the need for rather intricately shaped and more expensive metal actuating levers which have been used in the past.

Figure 6:
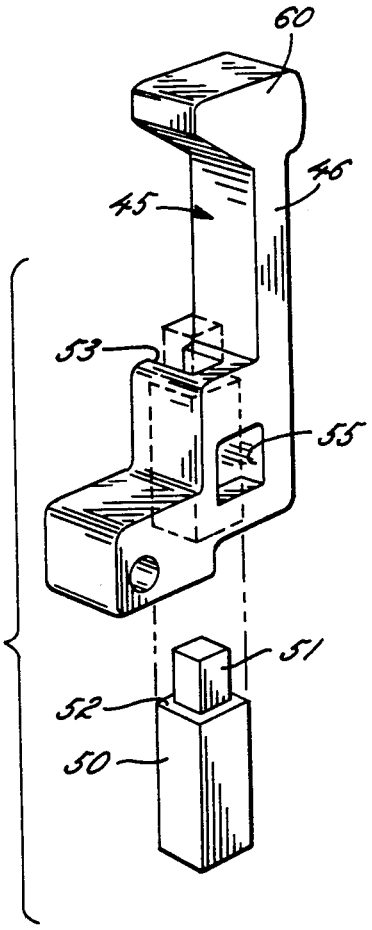
FIG. 6 is an exploded perspective view of the actuating lever and the actuating element.

More specifically, the actuator 45 includes an actuating lever 46 (FIG. 6) for activating the switch 30, the lever being molded from relatively hard plastic such as "Delrin". Near its lower end, the lever is supported to pivot about a horizontal axis by a pin 47 (FIG. 2) formed integrally with and projecting from the plate 21. Two cantilevered fingers 48 also project from the plate and captivate the lever 46 against the plate but not so tightly as to prevent limited pivoting of the lever about the pin 47.

Figure 3:
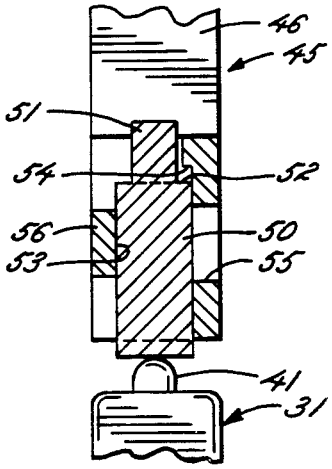
FIG. 3 is an enlarged fragmentary cross-section taken substantially along the line 3—3 of FIG. 2.

In keeping with the invention, the lever 46 carries a switch actuating element 50 (FIG. 6) which is adapted to pivot with the lever and which also moves relative to the lever to activate the switch 31. The present actuating element is in the form of a slide block of square cross-section and having an upper end portion 51 of reduced area so as to define an upwardly facing shoulder 52 on the slide block. The block 50 is supported to slide upwardly and downwardly within a vertically elongated slot 53 (FIG. 3) in the lever, the upper end portion of the slot being formed with a shoulder 54 which engages the shoulder 52 to limit the extent of upward movement of the block. As shown in FIG. 3, a window 55 in one side of the lever permits a molding pin (not shown) to extend laterally through the slot 53 during the molding process and to form a wall 56 for captivating the slide block laterally in the slot.

Figure 2:
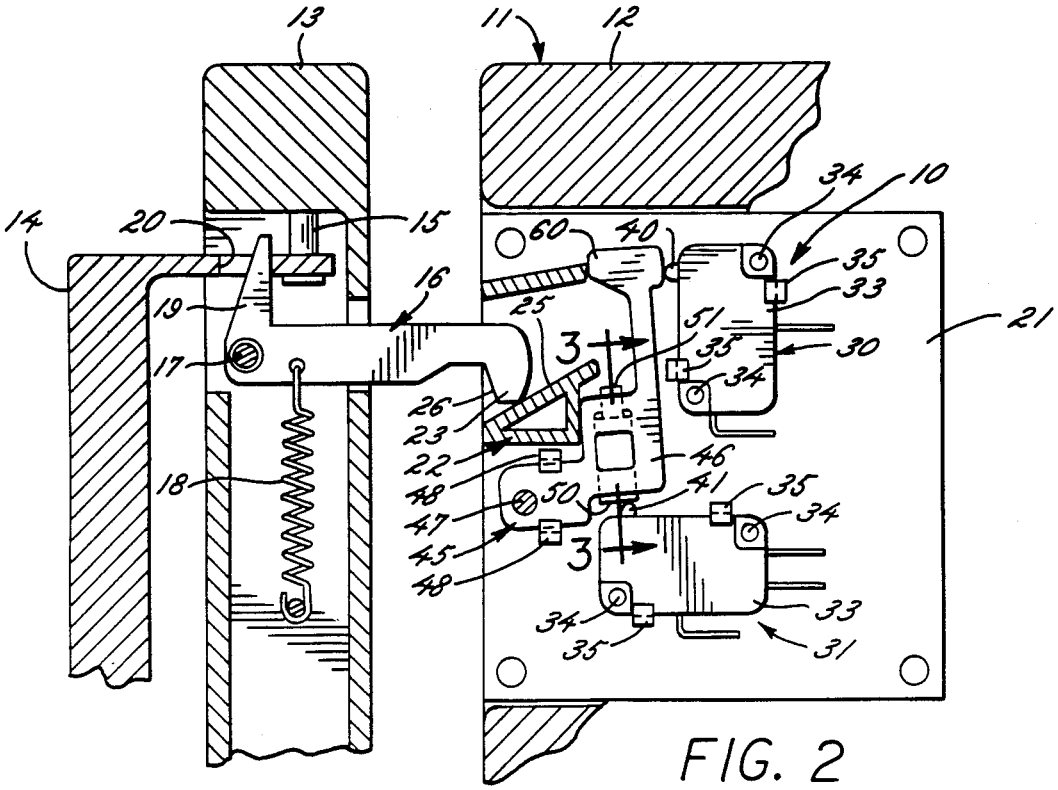
FIG. 2 is an enlarged fragmentary cross-section taken substantially along the line 2—2 of FIG. 1 and shows the door just starting to close.

When the door 13 is open as shown in FIG. 1 or just partially closed as shown in FIG. 2, the spring-loaded plunger 40 of the switch 30 engages a head 60 on the upper end portion of the lever 46 and urges the lever counterclockwise about the pin 47 to an inactive position in which the lever engages the rear edge of the strike 22. In addition, the spring-loaded plunger 41 of the switch 31 urges the slide block 50 upwardly to an inactive position in which the shoulders 52 and 54 engage one another.

Figure 4:
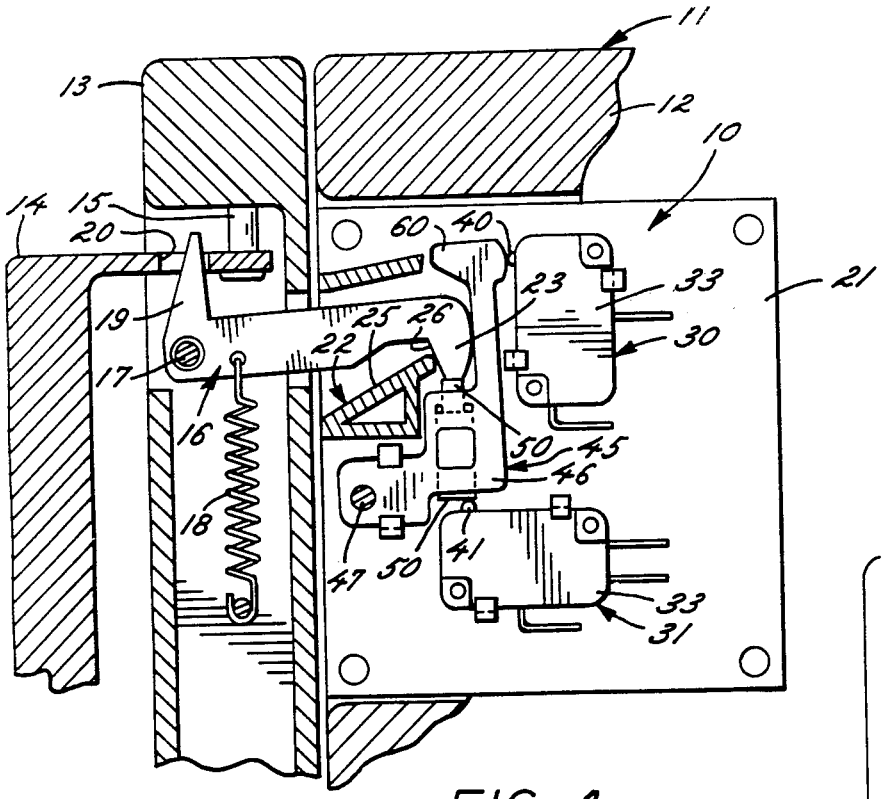
FIG. 4 is a view similar to FIG. 2 but shows the door in a more nearly closed position.
Figure 5:
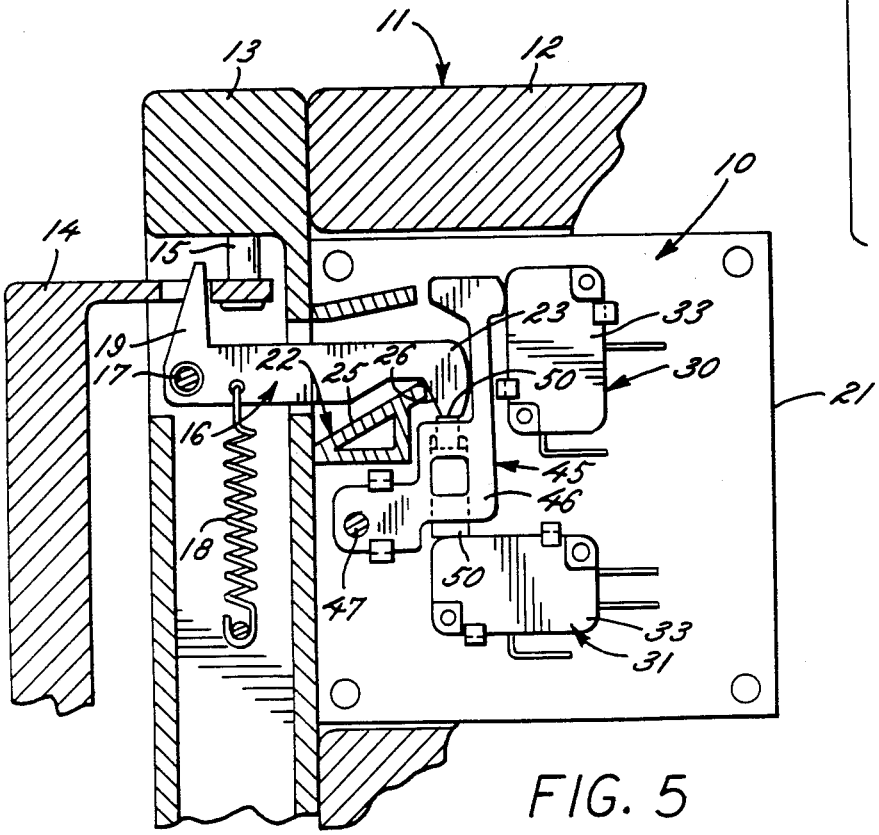
FIG. 5 also is a view similar to FIG. 2 but shows the door in its fully closed position.

As the door 13 approaches its closed position, the nose 23 of the latch 16 drops off of the rear edge of the ramp 25 of the strike 22 as shown in FIG. 4. At about the same time, the nose 23 engages the lever 46 and pivots the lever clockwise to an active position. As an incident to such pivoting, the head 60 of the lever 46 depresses the plunger 40 of the switch 30 and thus activates that switch (see FIG. 4).

With further closing of the door 13, the inclined surface 26 of the latch 16 moves downwardly along the rear edge of the ramp 25 so as to allow the nose 23 of the latch to move downwardly to its fully latched position (see FIG. 5). During such movement, the nose 23 engages the upper end of the slide block 50 and causes the slide block to move downwardly to an active position in which the block depresses the plunger 41 of the switch 31 in order to activate the same. Upon opening of the door 13, the spring-loaded plungers 40 and 41 extend to de-activate the switches 30 and 31 and to force the lever 46 and the slide block 50 to return to their inactive positions shown in FIG. 2.

From the foregoing, it will be apparent that the present invention brings to the art a new and improved switch assembly 10 in which the lever 46 and the slide block 50 coact to effect sequential activation of the switches 30 and 31. The components 46 and 50 can be molded and assembled in a relatively inexpensive manner and reduce the cost of the overall switch assembly 10.

I claim:

1. A switch assembly for use with a movable probe, said switch assembly comprising a mounting member, first and second electrical switches supported on said mounting member and each having an operator adapted to be shifted to a triggered position changing the state of the switch, and an actuator for shifting said switch operators to said triggered positions in response to movement of said probe, said actuator comprising a first actuating element supported on said mounting member to move between active and inactive positions, means biasing said first actuating element toward said inactive position, said first actuating element being disposed in the path of movement of said probe said, said first actuating element being moved to said active position when said probe is moved in a first direction and being operable when moved to said active position to shift the operator of said first switch to its triggered position, said actuator further comprising a second actuating element supported by said first actuating element to move with said first actuating element and also to move relative to said first actuating element between active and inactive positions, means biasing said second actuating element toward its inactive position, said second actuating element also being disposed in the path of movement of said probe, said second actuating element being moved to its active position when said probe is moved in a second direction and being operable when moved to its active position to shift the operator of said second switch to its triggered position.

2. A switch assembly as defined in claim 1 in which said first actuating element comprises a lever pivotally supported on said mounting member, said second actuating element being supported by said lever to pivot with said lever and to slide relative to said lever.

3. A switch assembly for use with a movable probe, said switch assembly comprising a mounting member, first and second electrical switches supported on said mounting member and each having an operator adapted to be shifted to a triggered position changing the state of the switch, and an actuator for shifting said switch operators to said triggered positions in response to movement of said probe, said actuator comprising a lever supported on said mounting member to pivot between active and inactive positions, means biasing said lever toward said inactive position, said lever being disposed in the path of movement of said probe, said lever being pivoted to said active position when said probe is moved in a first direction and being operable when pivoted to said active position to shift the operator of said first switch to its triggered position, said actuator further comprising an actuating element supported by said lever to pivot with said lever and also to move relative to said lever between active and inactive positions, means biasing said actuating element toward its inactive position, said actuating element also being disposed in the path of movement of said probe, said actuating element being moved to its active position when said probe is moved in a second direction and being operable when moved to its active position to shift the operator of said second switch to its triggered position.

4. A switch assembly as defined in claim 3 in which said actuating element is supported by said lever to slide between its active and inactive positions.

5. A switch assembly as defined in claim 4 in which said lever and said actuating element are disposed relative to said probe in such locations that said probe pivots said lever to its active position before said probe slides said actuating element to its active position.

6. A switch assembly as defined in claim 3 in which said lever and said actuating element are molded of plastic.

7. The combination of, a cabinet, a door movable between open and closed positions relative to the cabinet, a latch supported on said door to pivot upwardly and downwardly and biased downwardly to a latched position, and a switch assembly located in said cabinet, said switch assembly comprising a mounting member, a strike on said mounting member and shaped to hold said latch upwardly as said door initially approaches said closed position and then to allow said latch to pivot downwardly to said latched position as said door reaches said closed position, said switch assembly further comprising first and second electrical switches supported on said mounting member and each having an operator adapted to be shifted to a triggered position changing the state of the switch, said combination being characterized in that said switch assembly includes an actuator for shifting said switch operators to said triggered positions in response to movement of said latch, said actuator comprising a lever supported on said mounting member to pivot about a generally horizontal axis between active and inactive positions, means biasing said lever toward said inactive position, said lever being pivoted to said active position by said latch as said door approaches said closed position, said lever being operable when pivoted to said active position to shift the operator of said first switch to said triggered position, said actuator further comprising a slidable element supported by said lever to pivot with said lever and also to slide upwardly and downwardly relative to said lever between active and inactive positions, means biasing said slidably element upwardly to its inactive position, said slidable element being moved downwardly to its active position by said latch as said door reaches said closed position and said latch pivots downwardly to said latched position, and said slidable element being operable when moved away downwardly to its active position to shift the operator of said second switch to its triggered position.

* * * * *